US011878333B2

(12) United States Patent
Auer et al.

(10) Patent No.: US 11,878,333 B2
(45) Date of Patent: Jan. 23, 2024

(54) METHOD FOR HOT FORMING A SEMIFINISHED PRODUCT, IN PARTICULAR IN SHEET FORM

(71) Applicant: Bayerische Motoren Werke Aktiengesellschaft, Munich (DE)

(72) Inventors: Thomas Auer, Fuerstenfeldbruck (DE); Georgios Kalaitzidis, Freising (DE); Joerg Kutter, Munich (DE); Lisa-Marie Menter, Sankt Wolfgang (DE); Ulrich Schmid, Munich (DE); Ruediger Striefler, Erdweg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/295,944

(22) PCT Filed: Nov. 6, 2019

(86) PCT No.: PCT/EP2019/080427
§ 371 (c)(1),
(2) Date: May 21, 2021

(87) PCT Pub. No.: WO2020/114703
PCT Pub. Date: Jun. 11, 2020

(65) Prior Publication Data

US 2022/0001434 A1 Jan. 6, 2022

(30) Foreign Application Priority Data

Dec. 4, 2018 (DE) ..... 10 2018 130 860.4

(51) Int. Cl.
*B21D 22/02* (2006.01)
*B21J 1/06* (2006.01)

(52) U.S. Cl.
CPC ..... *B21D 22/022* (2013.01); *B21J 1/06* (2013.01)

(58) Field of Classification Search
CPC ..... C21D 2221/00; C21D 2221/01; C21D 2221/02; C21D 2221/10; C21D 1/673; B21J 1/06; B21D 22/022; B21D 22/208
See application file for complete search history.

(56) References Cited

U.S. PATENT DOCUMENTS 8,847,126 B2 * 9/2014 Ishiguro ..... C21D 9/46 219/600
2003/0189027 A1 10/2003 Garcia Gomez
(Continued)

FOREIGN PATENT DOCUMENTS

CN 102112636 A 6/2011
CN 105074017 A 11/2015
(Continued)

OTHER PUBLICATIONS

Machine Translation for DE102013212816A1 (Year: 2015).*
(Continued)

*Primary Examiner* — Jason L Vaughan
*Assistant Examiner* — Amanda Kreiling
(74) *Attorney, Agent, or Firm* — Crowell & Moring LLP

(57) ABSTRACT

A method for hot forming a semifinished product in sheet form for a motor vehicle component. The method includes heating the semifinished product to be formed in a heating process and forming the heated semifinished product in a shaping forming process. During the heating process the semifinished product undergoes an input of heat from at least one heat source. During the heating of the semifinished product, a shielding device is arranged between the heat source and the semifinished product, such that the semifinished product is thermally shielded at least in certain por-
(Continued)

tions in such a way that a first semifinished-product portion is heated differently than a second semifinished-product portion.

15 Claims, 3 Drawing Sheets

(56) References Cited

U.S. PATENT DOCUMENTS

| | | | | |
|---|---|---|---|---|
| 2011/0132897 | A1 | 6/2011 | Ishiguro et al. | |
| 2012/0097298 | A1 | 4/2012 | Sommer et al. | |
| 2015/0376728 | A1 | 12/2015 | Wada | |
| 2015/0377556 | A1 | 12/2015 | Ishiguro | |
| 2018/0265944 | A1 | 9/2018 | Skrikerud et al. | |
| 2020/0370831 | A1* | 11/2020 | Flesch | F27B 5/06 |

FOREIGN PATENT DOCUMENTS

| | | | | |
|---|---|---|---|---|
| CN | 108138249 | A | 6/2018 | |
| DE | 102 12 819 | A1 | 10/2003 | |
| DE | 10 2009 015 013 | A1 | 11/2010 | |
| DE | 10 2009 023 195 | A1 | 12/2010 | |
| DE | 20 2012 007 777 | U1 | 11/2012 | |
| DE | 10 2012 016 075 | A1 | 12/2013 | |
| DE | 10 2013 212 816 | A1 | 1/2015 | |
| DE | 10 2017 125 473 | B3 | 3/2019 | |
| DE | 102018103143 | A1 * | 8/2019 | C21D 1/09 |
| EP | 2 264 193 | A1 | 12/2010 | |
| EP | 2 322 672 | A1 | 5/2011 | |
| EP | 2 799 559 | A1 | 11/2014 | |
| EP | 3 156 506 | A1 | 4/2017 | |
| KR | 10-2013-0128498 | A | 11/2013 | |

OTHER PUBLICATIONS

International Search Report (PCT/ISA/210) issued in PCT Application No. PCT/EP2019/080427 dated Feb. 25, 2020 with English translation (seven (7) pages).

German-language Written Opinion (PCT/ISA/237) issued in PCT Application No. PCT/EP2019/080427 dated Feb. 25, 2020 (four (4) pages).

German-language Search Report issued in German Application No. 10 2018 130 860.4 dated Jul. 4, 2019 with partial English translation (12 pages).

English translation of Chinese Office Action issued in Chinese Application No. 201980067415.1 dated Mar. 14, 2022 with English translation (eight (8) pages).

* cited by examiner

METHOD FOR HOT FORMING A SEMIFINISHED PRODUCT, IN PARTICULAR IN SHEET FORM

BACKGROUND AND SUMMARY OF THE INVENTION

The disclosure relates to a method for hot forming a semifinished product, in particular in sheet form, to afford a component, in particular a motor vehicle component, comprising (a) heating the semifinished product to be formed in a heating process, wherein during the heating process the semifinished product undergoes an input of heat from at least one heat source and (b) forming the heated semifinished product in a shaping forming process.

Corresponding methods for hot forming a semifinished product, in particular in sheet form, to afford a component are fundamentally known from the prior art. By way of example, hot forming, i.e. forming a metal above its recrystallization temperature, takes place in press hardening. For this purpose, in a first step, the semifinished product to be formed or a blank is heated. The heated semifinished product is subjected to a forming process, e.g. a deep-drawing process, in the heated state.

The disclosure is based on the object of specifying a method which, in particular with respect to a simple, fast and cost-effective measure, makes it possible to design the material properties of a component produced in a hot forming method, in particular in a press hardening method, differently depending on the region.

This and other objects are achieved by a method for hot forming a semifinished product, in particular in sheet form.

The disclosure relates to a method for hot forming a semifinished product, in particular in sheet form, to afford a component, in particular a motor vehicle component, comprising (a) heating the semifinished product to be formed in a heating process, wherein during the heating process the semifinished product undergoes an input of heat from at least one heat source and (b) forming the heated semifinished product in a shaping forming process. The method is distinguished in that, during the heating of the semifinished product, a shielding device is arranged between the heat source and the semifinished product such that the semifinished product is thermally shielded at least in certain portions in such a way that a first semifinished-product portion is heated differently to a second semifinished-product portion. The hot forming method refers preferably to a direct or indirect hot forming method; here, a semifinished product, also referred to as a blank, for example a metal sheet, is heated to a temperature of approx. 950° C. and cooled during the shaping, in particular in a deep-drawing tool. The semifinished product is heated in a heating process, wherein the semifinished product undergoes an input of heat generated by a heat source. The semifinished product can for example be cut out of a continuous strip and, after the cutting process, can preferably already have at least in certain portions the two-dimensional basic form of the finished component. A three-dimensional component is formed from the semifinished product by a forming process, in particular a deep-drawing process. The direct hot forming is distinguished in that the final component form is produced in only one forming operation. The deep-drawing process can be effected, for example, using a holding-down means, a die and a punch, wherein preferably at least the die and/or the punch can be provided with cooling channels in order to cool the semifinished product during the deep-drawing process at least in certain regions and/or to achieve an output of heat from the heated semifinished product. The semifinished product can consist, for example, of a steel, in particular of a boron-manganese steel alloy.

In order to achieve properties of the semifinished product that differ depending on the region and thus also different properties of the component manufactured from the semifinished product, it can be provided that, during the heating of the semifinished product, before it is formed, a shielding device is arranged or formed between the at least one heat source and the semifinished product in such a way that the semifinished product is thermally shielded at least in certain portions or regions by the shielding device. This achieves the situation in which a first semifinished-product portion is heated differently to a second semifinished-product portion by the at least one heat source. Expressed differently, the shielding of the semifinished product by the shielding device at least in certain portions achieves the situation in which a first region of the semifinished product absorbs a first quantitative amount of heat of the input of heat and a second region of the semifinished product absorbs a second quantitative amount of heat of the input of heat different from the first quantitative amount of heat. Since the temperature of different regions of the semifinished product is controlled differently, the situation is achieved in which, after the heating, the properties, in particular the material properties, of the semifinished product are different depending on the region. After a semifinished product heated in this way has passed through a forming process, properties which differ depending on the region, in particular component properties which differ depending on the region, are also produced for the resulting component. The temperature control, which differs in a targeted manner, of the semifinished product can also be used in order to achieve a targeted behavior of the semifinished product that differs depending on the region within the forming method, in particular within the deep-drawing method.

The shielding device can extend on partial regions on both in the longitudinal direction and in the transverse direction of a semifinished product at least with its regions which have a heat-shielding action. A shielding device can thus be arranged or designed or designed for example in such a way that two or more separate regions are thermally shielded with respect to the heat source by the shielding device along a longitudinal and/or transverse axis of a semifinished product.

It is possible that, during the heating, the component is thermally shielded at least in certain portions by the shielding device in such a way that a first component portion has a temperature in a first temperature range and a second component portion has a second temperature in a second temperature range which differs from the first temperature range, preferably the first temperature range is in the range of from 750 to 1100° C., preferably in the range of from 775 to 1050° C., particularly preferably in the range of from 800 to 975° C., and the second temperature range is in the range of from 500 to 950° C., preferably in the range of from 600 to 950° C., particularly preferably in the range of from 650° C. to 850° C. The stated ranges of values can preferably be provided with the requirement that a first semifinished-product portion, which is not shielded by the shielding device, is heated to a temperature range which is higher at least by 10° C. than that of a second semifinished-product portion. During the heating, at least one semifinished-product portion is heated to for example 930° C. and in the process is converted to the austenitic range. This semifinished product is subsequently inserted into an e.g. water-cooled or oil-cooled tool (e.g. deep-drawing tool), is formed and/or held, and is thus cooled down to approximately 100-200° C. in a short time. A martensitic microstructure is obtained by this heat treatment. This increases the strength of the component and enables a tensile strength of up to 1650 MPa. The component becomes stronger as a result of the hot forming. In the course of this, however, the elongation at break decreases, i.e. the component becomes more brittle. Since the semifinished product undergoes less heating at least in certain portions as a result of shielding by means of the shielding device, in this region no increase in the strength of this nature is achieved compared to the non-shielded region. After the heating, the shielded region has a more ductile or more plastic behavior than the non-shielded region. Expressed differently, there is less input of heat in the at least one region of the semifinished product shielded by the shielding device, with the result that different zones or a mixed microstructure are/is produced, which in turn have/has an influence on the component properties during the subsequent hot forming. Overall, a dimensional stability of the components can be ensured to a high extent, since the forming and cooling take place in a process within the forming tool. Components of this type can be used for example in motor vehicles. Components of this type are suitable especially for use as a vehicle component conforming to a crash scenario, since in the event of a crash there is a higher capacity for energy absorption as a result of the regions with an enhanced ductile or plastic behavior.

At least one shielding device which is formed at least in certain portions from a thermally insulating material and/or from a thermally insulating material structure can expediently be used, in particular the shielding device is formed at least in certain portions from (a) a material and/or a material structure having a thermal conductivity in the range of from 0.03 to 0.25 W/mK, preferably in the range of from 0.08 to 0.20 W/mK, particularly preferably in the range of from 0.11 to 0.15 W/mK, at an average temperature of 800° C. and/or (b) a material and/or a material structure having a linear shrinkage behavior of less than 8%, preferably of less than 6%, particularly preferably of less than 4%, at 1100° C. after 24 hours. A material of this type or a material structure of this type ensures effective shielding of the partial region of the semifinished product to be shielded during the heating because of the thermal insulation property and the thermal resistance, and therefore ensures the achievement of an input of heat into the semifinished product that differs in certain regions. A thermal shock resistance can be advantageous since a defined region of the semifinished product is thus exposed to less heating even over a plurality of heating cycles. That is to say, e.g., that when using the shielding device for a multiplicity of heating processes, the semifinished products to be heated undergo a similar or identical temperature control or thermal shielding in specific regions.

The at least one shielding device can be formed at least in certain portions from fibers or from a fibrous material, preferably the shielding device comprises at least in certain portions natural fibers and/or synthetic fibers, particularly preferably the shielding device comprises at least in certain portions fibers of inorganic materials. Inorganic fibers of this type can comprise, for example, at least in certain portions ceramic fibers, quartz fibers, glass fibers, basalt fibers, carbon fibers, in particular composed of silicate fibers, in particular aluminum silicate fibers, and/or a glass fiber material.

As an alternative or in addition, at least one shielding device can be formed at least in certain portions from a porous material and/or from a porous material structure. The shielding device, in particular a shielding means, can thus be formed or manufactured from a melting method, a sintering method or a foaming method. The porous material and/or the porous material structure can be formed at least in certain portions from ceramic and/or steel, the shielding device is preferably formed at least in certain portions from porcelain and/or from a corrosion-resistant steel. In the case of a corrosion-resistant steel, the use of a heat-insensitive steel, i.e. a steel with a small degree of expansion behavior, can prove to be advantageous. In particular with respect to a shielding device which as far as possible can be utilized over a plurality of use cycles, it is advantageous when the form and dimensioning of the shielding device is maintained in order to always thermally shield a defined region of the semifinished product.

In an advantageous embodiment, it is expedient that at least one shielding device is used which has at least a first shielding portion with a first heat shielding property and a second shielding portion having a heat shielding property which differs from that of the first shielding portion, preferably the different heat shielding property is distinguished by a different thermal insulation property or capability and/or a different heat storage property or capability and/or a different thermal conduction property or thermal conductivity. The provision of at least one shielding device having two different heat shielding properties makes it possible to achieve the situation in which the semifinished product has at least three regions which are heated in a thermally different manner by the heat source. A first region of the semifinished product provided without a shielding device can be heated in an unimpeded manner by the heat source, with the result that this region absorbs a first quantitative amount of heat. A second region, shielded by a first shielding portion of the heating device, can be thermally shielded to a first degree in such a way that a second quantitative amount of heat, which is less than the first quantitative amount of heat of the non-shielded region, is absorbed thereby. Thermal shielding can take place in a third region, shielded from the heat source by a second shielding portion, to a second degree which differs from the first degree in such a way that a third quantitative amount of heat, which differs from the first and the second quantitative amount of heat, is absorbed thereby. It can thus be achieved that the semifinished product and also the later component have at least three predefined regions with different component properties. The at least two shielding portions can for example be achieved in that the shielding device, for the respective shielding portion, is different in at least one respect in terms of the material and/or the material structure and/or the arrangement and/or the volume and/or the weight and/or the geometry.

The at least one shielding device can have at least a first shielding portion with a first shielding means receiving unit for receiving a first shielding means and a second shielding portion with a second shielding means receiving unit for receiving a second shielding means, preferably the at least two shielding means are formed differently in terms of their material and/or material structure and/or arrangement and/or volume and/or weight and/or geometry. The shielding means receiving unit can be in the form, for example, of a container preferably provided with at least one recess in the surface facing the semifinished product and/or the heat source. The shielding means can be arrangeable in the container. The at least one recess makes possible a defined supply and/or conveyance of heat from the heat source to the semifinished product or to the shielding means. By way of example, a shielding means receiving unit has a cage-like form, wherein the shielding means is inserted in the inner region of the shielding means receiving unit. The shielding means can be fastened in the shielding means receiving unit in a force-fitting, form-fitting and/or materially bonded manner. In particular, the shielding means is fixed in the shielding means receiving unit in a form-fitting and/or force-fitting manner by at least one holding element.

The shielding device can comprise at least one holding means which holds or supports a shielding means, preferably the holding means is arranged or formed in such a way that the at least one shielding means is blocked at least in certain portions against thermal expansion. By way of example, the holding means is formed in a rigid and fixed manner in such a way that the shielding means connected in a materially bonded, form-fitting and/or materially bonded manner thereto prevents thermal expansion thereof or that thermal expansion thereof is performed to a reduced extent. This achieves the situation in which a shielding means remains constant in terms of its geometry and/or positional direction or alignment with respect to the semifinished product despite thermal stress. By way of example, a holding means surrounds the shielding means at at least two oppositely situated side regions, preferably at two side regions aligned at right angles to the longitudinal extent of a semifinished product.

The shielding device can be formed in such a way that, during the heating of the semifinished product, the semifinished product is thermally shielded at least in certain portions on a top side and at least in certain portions on a bottom side. The shielding device preferably thermally shields the semifinished product in a congruent and/or oppositely situated shielding region on its top and bottom side. For this purpose, the shielding device can engage around the semifinished product at least in certain portions for example during the heating. In this way, both a top side and a bottom side of the semifinished product are thermally shielded at the same time by the shielding device.

In a further embodiment, the shielding device has a c-shaped form at least in certain portions. The shielding device preferably has two free limbs which are spaced apart by at most 15 mm, preferably by at most 10 mm, particularly preferably by at most 5.5 mm. The semifinished product can be arranged at least in certain portions in the interior space of the c-shaped shielding device for example during the heating in the heating process. On the top side and/or on the bottom side, the shielding device preferably has a stiffening means, which is formed in such a way that the upper and/or lower limb of the c-shaped shielding device does not undergo any deformation, whether as a result of its own weight and/or as a result of alternating thermal loading. In this way, it is possible to prevent distortion of the shielding device connected to the stiffening means, in particular in a rigid manner, caused by temperature fluctuations, for example by virtue of at least one stiffening means which is optimized with respect to its thermal insensitivity.

It is possible that the semifinished product is fed to a heating region in a manner arranged, in particular resting, on a product carrier, in particular a grid-like product carrier, and the semifinished product is heated in the heating region, preferably the shielding device can be fastened to the product carrier via a fastening device in particular releasably, i.e. releasably in a non-destructive manner. The shielding device can particularly preferably be fastened in the manner of a grid pattern to at least two regions of the product carrier, in particular temporarily. The product carrier facilitates displacement of the semifinished product, with the result that at least one semifinished product located on the product carrier can be moved into the heating region and out of the heating region by a movement of the product carrier. Since the shielding device can be fastened to the product carrier outside the heating region, the situation can be achieved in which, during the assembly and/or disassembly of the shielding device on the product carrier, the heating region can be used for other heating processes. The product carrier can preferably have a corresponding shielding device receiving device for at least two fastening positions and/or fastening alignments of the shielding device. This achieves the situation in which a shielding device can be fastened easily and comfortably to the product carrier at the corresponding fastening positions and/or in the corresponding fastening alignments in a simple and repeatable manner. For this purpose, the at least two fastening devices, in particular arranged on the product carrier, can be present on the product carrier and/or on the shielding device in the manner of a grid pattern. The fastening device of the product carrier can indirectly or directly receive and/or fasten a shielding device at least in certain portions.

It is possible that the at least one product carrier comprises at least one shielding device receiving device, into which a shielding device can be received at least temporarily and/or in certain portions, preferably the shielding device receiving device can be arranged and/or formed in such a way that thermal expansion of at least one shielding device received in the shielding device receiving device is reduced or prevented. By virtue of the fact that the shielding device receiving device is arranged or formed on the product carrier, the product carrier can be quickly loaded with a shielding device. The shielding device receiving device can also be connected releasably to the product carrier. In this respect, the shielding device receiving device can be fastenable to the product carrier at at least two predefined fastening locations, in particular in a grid pattern structure.

The semifinished product used can for example have a thickness of from 0.1 to 4.0 mm, preferably a thickness of from 1.5 to 3.2 mm, particularly preferably a thickness of from 2.2 to 2.6 mm. As an alternative or in addition, the semifinished product can be formed at least in certain portions from metal, preferably the semifinished product is formed at least in certain portions from steel, particularly preferably the semifinished product is formed at least in certain portions from hot-forming steel. A hot-forming steel can be for example a hot-formable steel such as e.g. a boron-manganese steel, preferably Zn(zinc)-coated; use is made in particular of a boron-manganese steel 22MnB5. A CR300 MB, in particular a CR300 MB-UC, or a CR380 MB, in particular a CR380 MB GI70/70, can specifically be used.

In addition to the method for hot forming a semifinished product, in particular in sheet form, to afford a component, the disclosure also relates to a shielding device for thermally shielding a semifinished product at least in certain portions for a hot forming method according to the production method described here.

All advantages, details, embodiments and/or features of the method according to the disclosure can be transferred and applied to the shielding device according to the disclosure.

Other objects, advantages and novel features of the embodiments of the present disclosure will become apparent from the following detailed description of one or more preferred embodiments when considered in conjunction with the accompanying drawings, in which:

DETAILED DESCRIPTION OF THE DRAWINGS

Figure 3:
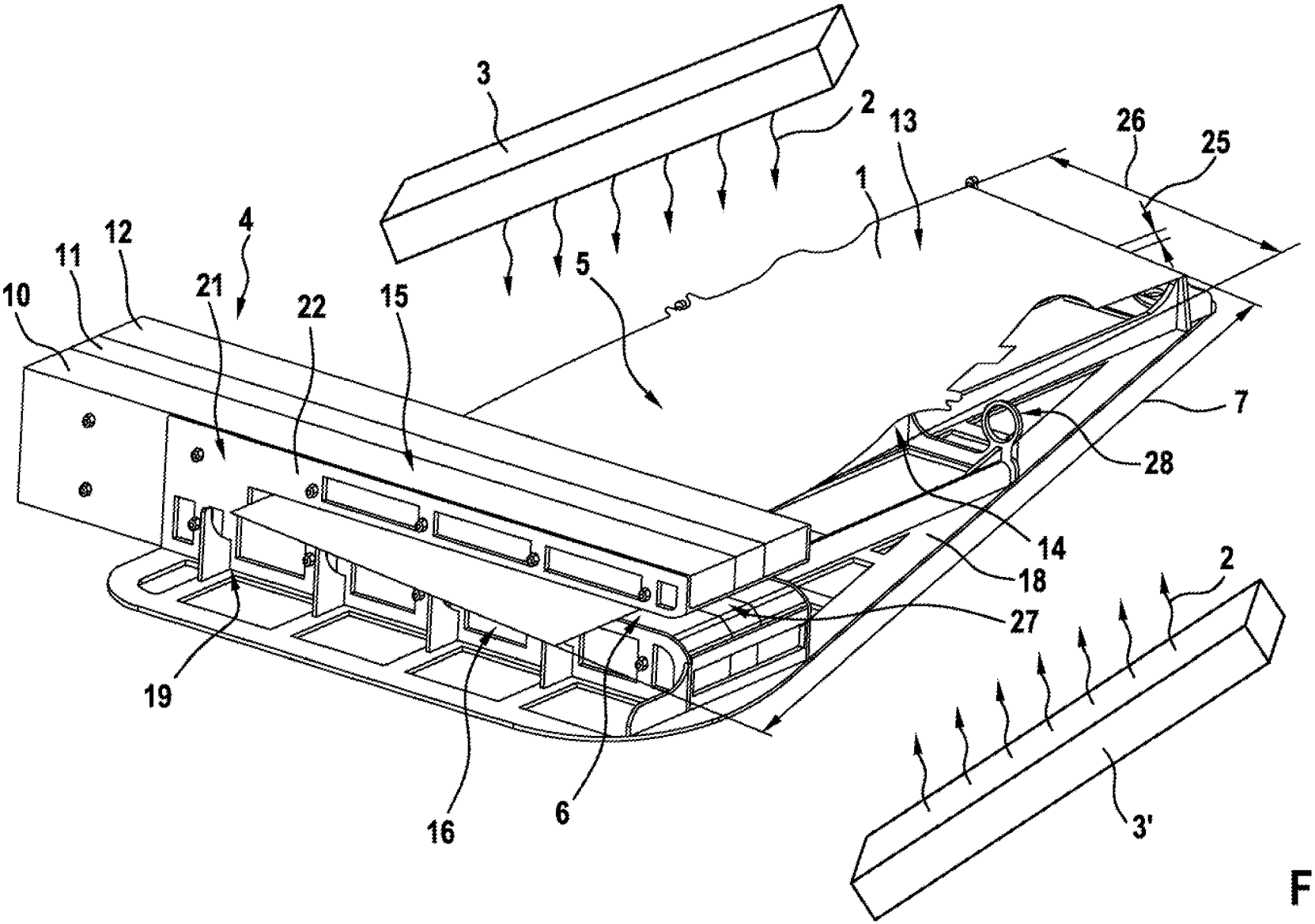
FIG. 3 is a basic illustration of a semifinished product arranged in an interior space of a shielding device.

The figures show basic illustrations of the essential parts of an exemplary apparatus for carrying out a method for hot forming a semifinished product 1, in particular in sheet form, to afford a component (not illustrated), in particular a motor vehicle component, comprising (a) heating the semifinished product 1 to be formed in a heating process, wherein during the heating process the semifinished product 1 undergoes an input of heat 2, 2' (indicated in the figures as thermal rays) from at least one heat source 3, 3' and (b) forming the heated semifinished product 1 in a shaping forming process (not illustrated), wherein, during the heating of the semifinished product 1, a shielding device 4 is arranged between the heat source 3, 3' and the semifinished product 1 such that the semifinished product 1 is thermally shielded at least in certain portions in such a way that a first semifinished-product portion 5 is heated differently to a second semifinished-product portion 6. The heat sources 3, 3' are schematically illustrated in the figures and can extend preferably over or else beyond the entire length 7 of the semifinished product 1 and/or over or else beyond the entire length 8 of a heating table 9. During the heating, the semifinished product 1 is thermally shielded at least in certain portions by the shielding device 4 in such a way that a first semifinished-product portion 5 has a temperature in a first temperature range and a second semifinished-product portion 6 has a second temperature in a second temperature range which differs from the first temperature range, preferably the first temperature range is in the range of from 750 to 1100° C., preferably in the range of from 775 to 1050° C., particularly preferably in the range of from 800 to 975° C., and the second temperature range is in the range of from 500 to 950° C., preferably in the range of from 600 to 950° C., particularly preferably in the range of from 650° C. to 850° C. In this respect FIG. 3 illustrates that a first semifinished-product portion 5 is heated directly and thus without a shielding device 4 by the heat sources 3, 3', whereas the second semifinished-product portion 6 is thermally shielded on both sides by the shielding device 4 with respect to the heat sources 3, 3'. Consequently, after the heating, the first semifinished-product portion 5 has a higher temperature than the second semifinished-product portion 6.

The at least one shielding device 4 is formed at least in certain portions from a thermally insulating material and/or from a thermally insulating material structure. In particular, the shielding device 4 is formed at least in certain portions from (a) a material and/or a material structure having a thermal conductivity in the range of from 0.03 to 0.25 W/mK, preferably in the range of from 0.08 to 0.20 W/material constituent, particularly preferably in the range of from 0.11 to 0.15 W/mK, at an average temperature of 800° C. and/or (b) a material and/or a material structure having a linear shrinkage behavior of less than 8%, preferably of less than 6%, particularly preferably of less than 4%, at 1100° C. after 24 hours.

The shielding device 4 can be formed at least in certain portions from fibers, preferably the shielding device 4 comprises at least in certain portions natural fibers and/or synthetic fibers, particularly preferably the shielding device 4 comprises at least in certain portions fibers of inorganic materials. Inorganic fibers of this type can comprise, for example, at least in certain portions ceramic fibers, quartz fibers, glass fibers, basalt fibers, carbon fibers, in particular composed of silicate fibers, and/or a glass fiber material. The shielding device 4 can be formed at least in certain portions from a porous material and/or from a porous material structure.

By way of example, the at least one shielding device 4 can have at least a first shielding portion 10 with a first heat shielding property and a second shielding portion 11 having a heat shielding property which differs from that of the first shielding portion 10. In the exemplary embodiments illustrated in the figures, the shielding device 4 has three shielding portions 10, 11, 12 arranged or formed next to one another. These shielding portions 10, 11, 12 can preferably be distinguished by different heat shielding properties (e.g. by different thermal insulation properties and/or different heat storage properties and/or different thermal conduction properties). This makes it possible to achieve the situation in which the regions of the semifinished product 1 arranged between the respective shielding portions 10, 11, 12 undergo different degrees of heating by the heat source 3, 3' and thus a targeted heating of the respective regions and ultimately a targeted influence of the properties, in particular the material properties, of the respective regions can be achieved. In the embodiment illustrated, the shielding device 4 extends over the entire width 26 of the semifinished product 1; it can also be expedient that the shielding device 4 and/or at least that region of the shielding device 4 which has a thermally insulating action does not extend over the entire width 26 of the semifinished product 1.

Figure 1:
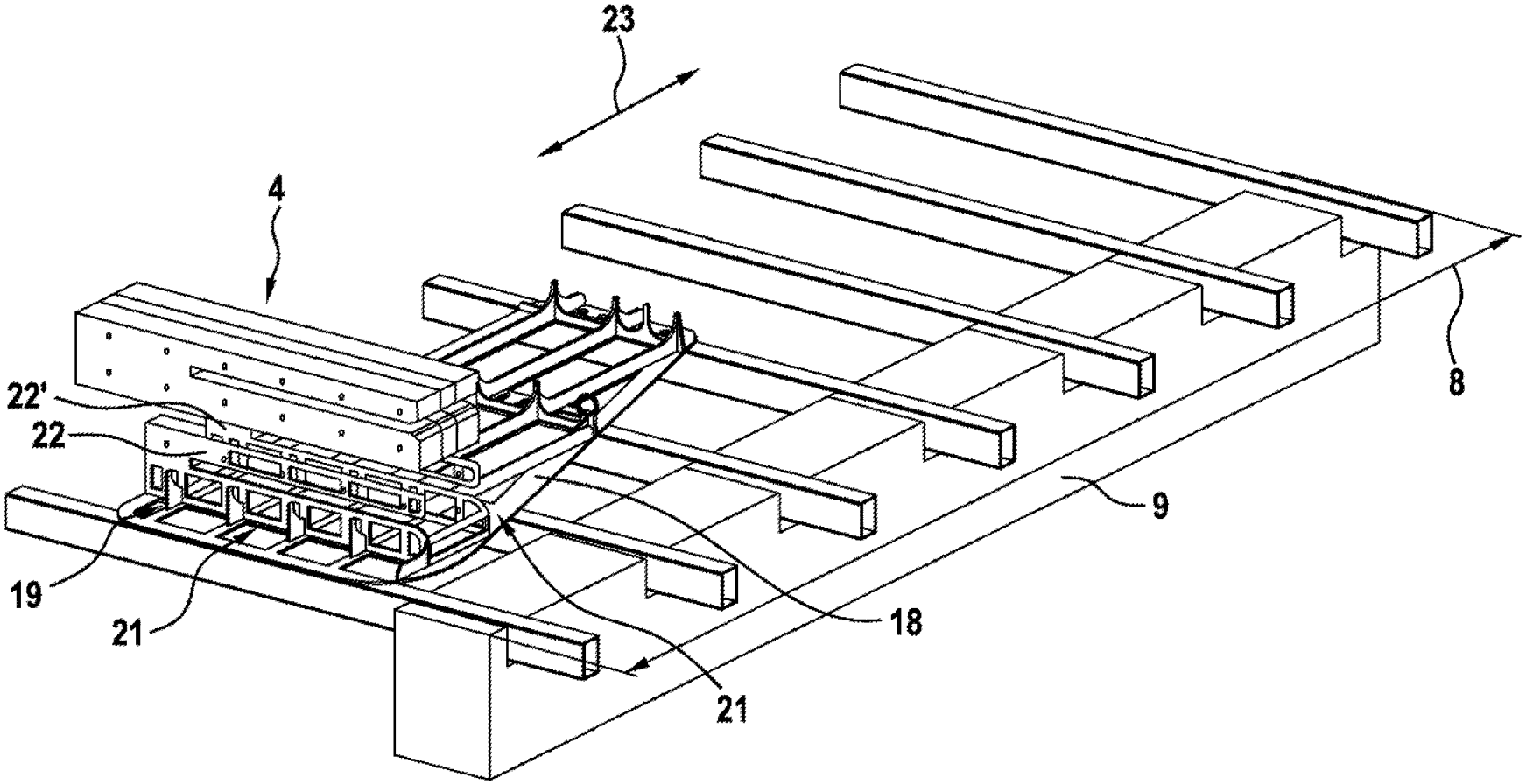
FIG. 1 is a basic illustration of a product carrier, a shielding device and a heating table.

The shielding device 4 can have a first shielding portion 10 with a first shielding means receiving unit (not illustrated) for receiving a first shielding means (not illustrated) and a second shielding portion with a second shielding means receiving unit for receiving a second shielding means, preferably the at least two shielding means are formed differently in terms of their material and/or material structure and/or arrangement and/or volume and/or weight and/or geometry. In this way, it is possible to provide a shielding device 4 which is loaded as required, depending on the region, with shielding means which differ in terms of their thermal insulation behavior. Consequently, a different action of heat on the semifinished product 1 by the heat source 3, 3' can be achieved depending on the region, in particular both along a longitudinal extent and along a transverse extent of the semifinished product 1 to be heated. FIG. 3 illustrates the assembly position during the heating; here, the assembly illustrated with the semifinished product 1 is arranged in a heating region provided with a heating table 9, cf. FIG. 1.

The shielding device 4 can comprise at least one supporting means (not illustrated) which supports a shielding means, preferably the supporting means is arranged or formed in such a way that thermal expansion of at least one shielding means is reduced or prevented. The shielding device 4 can thus comprise elements which make it possible to reduce or prevent the thermal expansion of the shielding means.

The shielding device 4 can be formed or configured according to the exemplary embodiment illustrated in such a way that, during the heating of the semifinished product 1 by the heat sources 3, 3', the semifinished product 1 is thermally shielded at least in certain portions on a top side 13 and at least in certain portions on a bottom side 14, preferably the shielding device 4 thermally shields the semifinished product 1 in a congruent and/or oppositely situated shielding region on its top and bottom side 13, 14.

For this purpose, the shielding device can have a c-shaped form, for example. In particular, the two free limbs 15, 16 of the c-shape can be spaced apart by at most 15 mm, preferably by 10 mm, particularly preferably by 5.5 mm. The semifinished product 1 can be arranged at least in certain portions in the interior space 17 of the shielding device 4, which is c-shaped at least in certain portions, during the heating in the heating process. The sheet-like semifinished product 1 can be introduced or inserted into and guided out of or removed from the interior space 17 of the shielding device 4 through the region of the c-shaped shielding device 4 forming an opening 27.

The semifinished product 1 can be fed to a heating region in a manner arranged, in particular resting, on a product carrier 18, in particular a grid-like product carrier, wherein the semifinished product 1 is heated in the heating region, preferably the shielding device 4 can be fastened to the product carrier 18 via a fastening device 19 in particular releasably. The shielding device 4 can be fastenable in the manner of a grid pattern to at least two regions of the product carrier 18, in particular temporarily.

Figure 2:
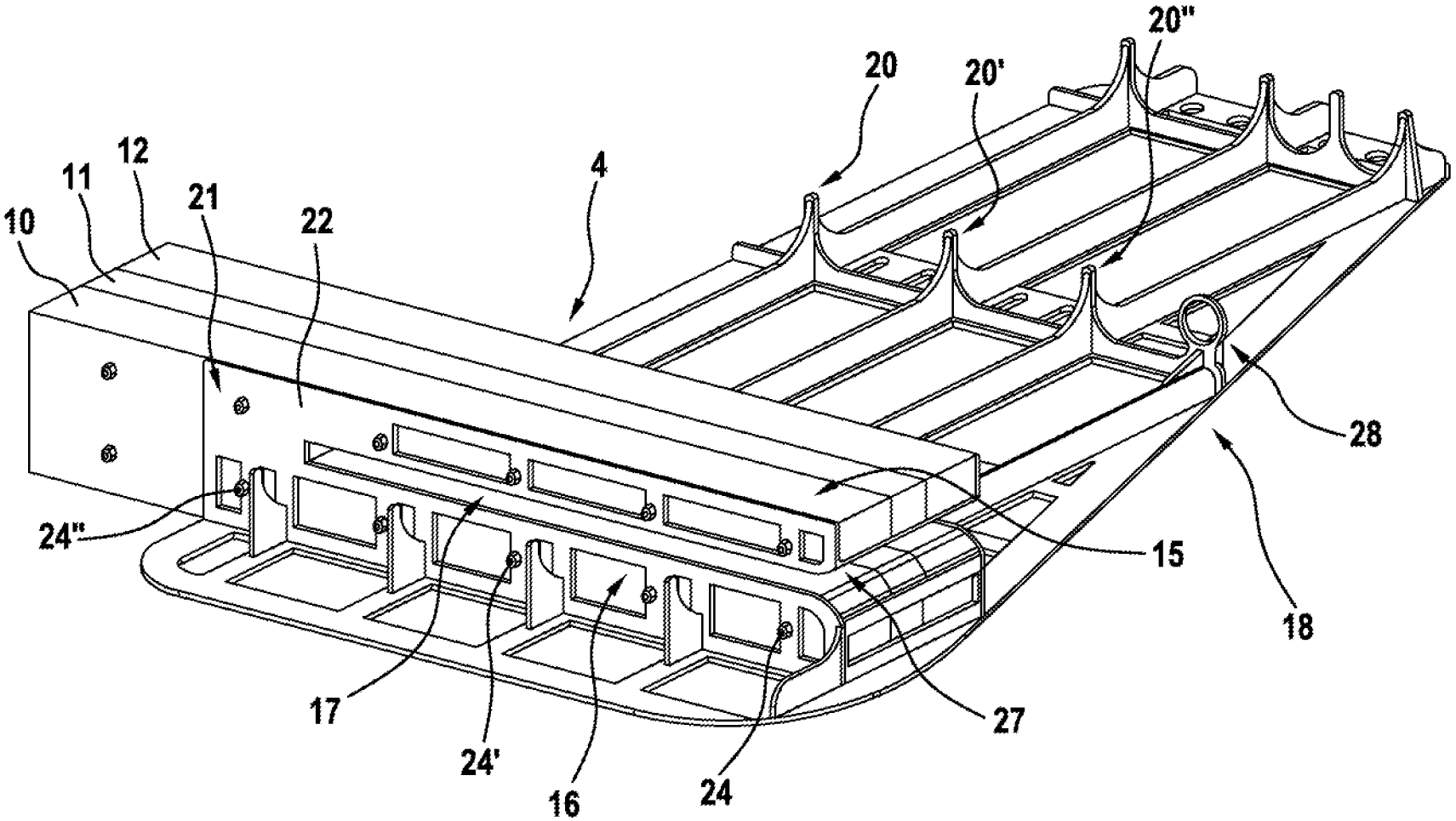
FIG. 2 is a basic illustration of a shielding device arranged on a product carrier.

The product carrier 18 has supporting portions 20, 20', 20" for supporting a semifinished product 1 placed on the product carrier 18. The supporting portions 20, 20', 20" have a small contact surface, in particular punctiform or spot-like contact regions, with the semifinished product 1 to be deposited on the product carrier 18. The product carrier 18 can be provided with a holding device 28 in order for a manipulator (not illustrated) or a tool (not illustrated) to grip the product carrier 18 or to move such that the product carrier is displaced. For this purpose, the holding device 28 can be configured by way of example, as can be seen in FIG. 2, as an eyelet which is arranged in the grid structure, is preferably formed in one piece with the grid structure and in particular has a supporting function comparable to the supporting portions 20, 20', 20" for a semifinished product 1 which is to be placed on.

The at least one product carrier 18 can preferably comprise at least one shielding device receiving device 21, into which a shielding device 4 can be received at least temporarily, preferably the shielding device receiving device 21 is arranged or formed in such a way that thermal expansion of at least one shielding device 4 received in the shielding device receiving device 21 is reduced or prevented. The shielding device receiving device 21 can touch the shielding device 4 at least at two oppositely situated sides of the shielding device 4 and thus inhibit or reduce the expansion of the shielding device 4 at least in this direction. In the embodiment illustrated, the shielding device receiving device 21 is designed in the form of two elongate, sheet-like and grid-like receiving elements 22, 22' which are fastened to the product carrier 18 in a form-fitting, materially bonded and/or force-fitting manner. The receiving elements 22, 22' can preferably be fastened to one of at least two predefined fastening locations of the product carrier that are arranged in particular in the manner of a grid pattern. The shielding device 4 is inserted between these two receiving elements 22, 22' preferably without play and is consequently blocked or impeded from expansion in at least one direction, illustrated here by way of example in the longitudinal direction 23 of the product carrier 18 illustrated. The receiving elements 22, 22' likewise have a c-shape, wherein the semifinished product 1 is arranged temporarily in the inner region of the c-shaped receiving elements 22, 22', cf. FIG. 3. The two receiving elements 22, 22' are connected via preferably rod-shaped holding means 24, 24', 24". The holding means 24, 24', 24" can hold or fix the shielding device between the receiving elements 22, 22' and/or block a relative movement of the two receiving elements 22, 22' at least in one spatial direction. The at least one holding means 24, 24', 24" is preferably arranged or formed in such a way that the at least one shielding device 4 is blocked against thermal expansion at least in certain portions. By way of example, the holding means 24, 24', 24" is formed in a rigid and fixed manner in such a way that the shielding device 4 connected thereto in a materially bonded, form-fitting and/or materially bonded manner is blocked against thermal expansion thereof or prevented from thermally expanding. In this way, the situation is achieved in which a shielding device 4 remains constant in terms of its geometry and/or positional direction and/or alignment with respect to the semifinished product despite thermal stress during the heating. In particular, the holding means 24, 24', 24" can prevent or reduce a relative movement of the shielding device 4 with respect to the receiving elements 22, 22' and/or with respect to the product carrier 18. It is thus possible, for example, to keep the gap dimension of the c-shaped opening 27 or the spacing of the two limbs 15, 16 of the c-shaped shielding device 4 constant or at least approximately constant. In the embodiment illustrated, the holding means 24, 24', 24" are formed as threaded rods provided with nuts at the end. The shielding device receiving device 21 can be in the form for example of at least one supporting template for a heat-absorber mass or heat-absorbing mass for the shielding means and/or for the shielding device 4.

The semifinished product 1 can have a thickness 25 or a sheet thickness of from 0.1 to 4.0 mm, preferably a thickness 25 of from 1.5 to 3.2 mm, particularly preferably a thickness 25 of from 2.2 to 2.6 mm. The semifinished product 1 can be formed at least in certain portions from metal, preferably the semifinished product 1 is formed at least in certain portions from steel, particularly preferably the semifinished product is formed at least in certain portions from a hot-forming steel.

LIST OF REFERENCE SIGNS

1 Semifinished product
2, 2' Input of heat
3, 3' Heat source
4 Shielding device
5 First semifinished-product portion
6 Second semifinished-product portion
7 Length of 1
8 Length of 9
9 Heating table
10 First shielding portion
11 Second shielding portion
12 Third shielding portion
13 Top side of 1
14 Bottom side of 1
15 First limb
16 Second limb
17 Interior space
18 Product carrier
19 Fastening device
20, 20', 20" Supporting portion
21 Shielding device receiving device
22, 22' Receiving element
23 Longitudinal direction
24, 24', 24" Connecting threaded rods
25 Thickness of 1
26 Width of 1
27 Opening in 4
28 Holding device

What is claimed is:

1. A method for hot forming a semifinished product in sheet form for a motor vehicle component, the method comprising heating the semifinished product to be formed in a heating process, wherein during the heating process the semifinished product undergoes an input of heat from at least one heat source; and forming the heated semifinished product in a shaping forming process, wherein during the heating of the semifinished product, at least one shielding device is arranged between the heat source and the semifinished product, such that the semifinished product is thermally shielded at least in certain portions in such a way that a first semifinished-product portion is heated differently than a second semifinished-product portion, and at least one surface of a first shielding device directly contacts a surface other than that of the semifinished product.

2. The method according to claim 1, wherein during the heating, the semifinished product is thermally shielded at least in certain portions by the shielding device in such a way that a first semifinished-product portion has a temperature in a first temperature range and a second semifinished-product portion has a second temperature in a second temperature range which differs from the first temperature range, the first temperature range is in the range of from 750° C. to 1100° C., and the second temperature range is in the range of from 500° C. to 950° C.

3. The method according to claim 2, wherein the at least one shielding device is formed at least in certain portions from a thermally insulating material and/or from a thermally insulating material structure, the shielding device being formed at least in certain portions from a material and/or a material structure having a thermal conductivity in the range of from 0.03 W/mK to 0.25 W/mK, at an average temperature of 800° C. and/or a material and/or a material structure having a linear shrinkage behavior of less than 8% at 1100° C. after 24 hours.

4. The new method according to claim 3, wherein the at least one shielding device is formed at least in certain portions from natural fibers and/or synthetic fibers of inorganic materials.

5. The method according to claim 3, wherein the at least on shielding device is formed at least in certain portions from a porous material and/or from a porous material structure.

6. The method according to claim 5, wherein the at least one shielding device has at least a first shielding portion with a first heat shielding property and a second shielding portion having a heat shielding property which differs from that of the first shielding portion, and the different heat shielding property is distinguished by a different thermal insulation property and/or a different heat storage property and/or a different thermal conduction property.

7. The method according to claim 6, wherein the at least one shielding device is used which has at least a first shielding portion with a first shielding means receiving unit for receiving a first shielding means and at least a second shielding portion with a second shielding means receiving unit for receiving a second means, the at least two shielding means being formed differently in terms of their material and/or material structure and/or arrangement and/or volume and/or weight and/or geometry.

8. The method according to claim 7, wherein during the heating of the semifinished product, the at least one shielding device thermally shields the semifinished product at least in certain portions on a top side and at least in certain portions on a bottom side, the shielding device thermally shielding the semifinished product in a congruent and/or oppositely situated shielding region on its top and bottom side.

9. The method according to claim 8, wherein the at least one shielding device has a c-shape form and two free limbs of the c-shaped shielding device are spaced apart by at most 15 mm, and the semifinished product is arranged at least in certain portions in an interior space of the c-shaped shielding device during the heating in the heating process.

10. The method according to claim 9, wherein the semifinished product is fed to a heating region such that the semifinished product rests on a grid-like product carrier, and the semifinished product is heated in the heating region, the shielding device being fastenable to the product carrier via a fastening device in a releasable fashion, so that the shielding device is fastenable in the matter of a grid pattern to at least two regions of the product carrier temporarily.

11. The method according to claim 10, wherein the at least one product carrier comprises at least one shielding device receiving device, into which a shielding device is receivable at least temporarily, the shielding device receiving device being arranged and/or formed in such a way that thermal expansion of at least one shielding device received in the shielding device receiving device is reduced or prevented.

12. The method according to claim 11, wherein the semifinished product has a thickness of from 0.1 mm to 4.0 mm.

13. The method according to claim 12, wherein the semifinished product is formed at least in certain portions from a metal, including at least one of a steel and a hot-forming steel.

14. A shielding device for thermally shielding a semifinished product at least in certain portions from a hot forming method according to claim 13.

15. The method according to claim 1, wherein during the heating of the semifinished product, a second shielding device is arranged between the heat source and the semifinished product, such that the semifinished product is thermally shielded at least in certain portions in such a way that a third semifinished-product portion is heated differently than a first semifinished-product portion and a second semifinished-product portion, thus creating three predefined regions of the semifinished-product with different component properties, wherein the second shielding device is different from the first shielding device in terms of at least the material, material structure, volume, weight, or geometry.

* * * * *